US007950822B2

(12) United States Patent
Deng

(10) Patent No.: US 7,950,822 B2
(45) Date of Patent: May 31, 2011

(54) DETACHABLE BALLAST HOUSING

(76) Inventor: Jia H Deng, Diamond Bar, CA (US)

( * ) Notice: Subject to any disclaimer, the term of this patent is extended or adjusted under 35 U.S.C. 154(b) by 169 days.

(21) Appl. No.: 12/200,353

(22) Filed: Aug. 28, 2008

(65) Prior Publication Data

US 2009/0059577 A1 Mar. 5, 2009

Related U.S. Application Data

(60) Provisional application No. 60/966,730, filed on Aug. 28, 2007.

(51) Int. Cl.
*F21V 23/02* (2006.01)
*F21S 4/00* (2006.01)

(52) U.S. Cl. ..... 362/221; 362/225

(58) Field of Classification Search ..... 362/217.01, 362/221, 225; 315/210–214, 41, 58
See application file for complete search history.

(56) References Cited

U.S. PATENT DOCUMENTS 5,253,152 A * 10/1993 Yang et al. ..... 362/221
6,102,550 A * 8/2000 Edwards, Jr. ..... 362/221
6,439,740 B1 * 8/2002 Yan ..... 362/216
7,090,390 B2 * 8/2006 Pazula ..... 362/650

* cited by examiner

*Primary Examiner* — Stephen F Husar
*Assistant Examiner* — James W Cranson
(74) *Attorney, Agent, or Firm* — FSP LLC

(57) ABSTRACT

A detachable ballast housing for use with fluorescent lights includes a ballast, a housing for the ballast, and electrical contacts for detachably mounting and dismounting to a lighting fixture without connecting or disconnecting power wires.

4 Claims, 4 Drawing Sheets

DETACHABLE BALLAST HOUSING

PRIORITY

This application claims priority under 35 USC 119 to U.S. provisional application No. 60/966,730 filed on Tuesday, Aug. 28, 2007, which is incorporated herein by reference in its entirety.

TECHNICAL FIELD

The present disclosure relates to ballasts and mounts for fluorescent lighting.

BACKGROUND

Fluorescent bulbs requires a ballast in order to start and maintain lighting. The bulbs and also the ballasts are subject to wearing out over time. Typically, changing the ballast involves disconnecting wiring of the lighting fixture from the electrical power source, which is inconvenient and potentially unsafe.

BRIEF DESCRIPTION OF THE DRAWINGS

In the drawings, the same reference numbers and acronyms identify elements or acts with the same or similar functionality for ease of understanding and convenience. To easily identify the discussion of any particular element or act, the most significant digit or digits in a reference number refer to the figure number in which that element is first introduced.

DETAILED DESCRIPTION

References to "one embodiment" or "an embodiment" do not necessarily refer to the same embodiment, although they may.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
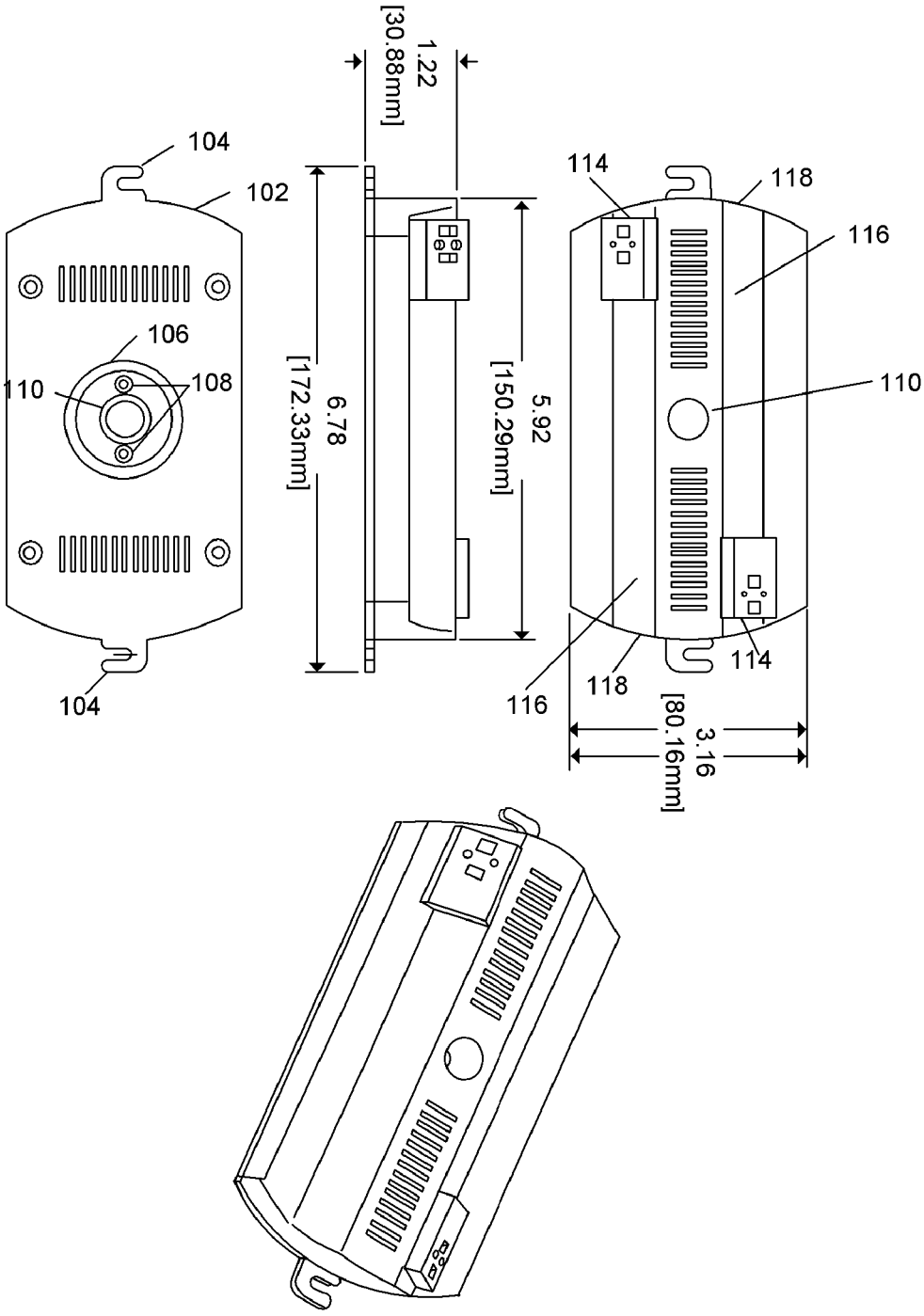
FIG. 1 is an illustration of various views of an embodiment of a detachable center hole of ballast housing connect with any compact fluorescent lamp holders.

FIG. 1 is an illustration of various views of an embodiment of a detachable ballast housing.

The housing 102 includes a recessed mounting disc 106. The disc 106 may have a 1.1" or larger outer diameter and electrical contacts 108 compatible with a GU24 lamp interface. The contacts 108 may measure 24 mm from center to center. The mounting disc 106 and contacts 108 may be employed to detachably mount the housing 102 to an electrical light fixture having a GU24 compatible mount. A mounting hole 110 (e.g. having 0.40" outer diameter, or larger) is also available to accept a threaded fixture mounting tube. Receptacles 114 are available to accept either compact fluorescent tubes (possibly having different types of fluorescent lamp holders) or "circline" lights. In this embodiment, two compact fluorescent lights may be mounted along 116 of the housing 102. The sides 118 of the housing 102 are adapted with curvature to accept a circline light, for example one having an outer diameter of 5.9" or smaller. In one embodiment the housing has a profile of 1.22 inches or less, or 1.25 inches or less, which facilitates proper light dispersion and patterning. The length of the housing 102 may be six inches or less.

Although shown with two lamp interfaces 114, each compatible with multiple types of compact fluorescent sockets, other embodiments may comprise only a single interface. A single ballast within the housing 102 may be used to drive one or more compact fluorescent lamps. The hole 110 may have an outer diamer of 10 mm or larger.

The housing 102 further includes slotted tabs 104 which may accept screws, nails, or other retaining mechanisms to help stabilize the housing 102 once it is mounted in place.

Figure 2:
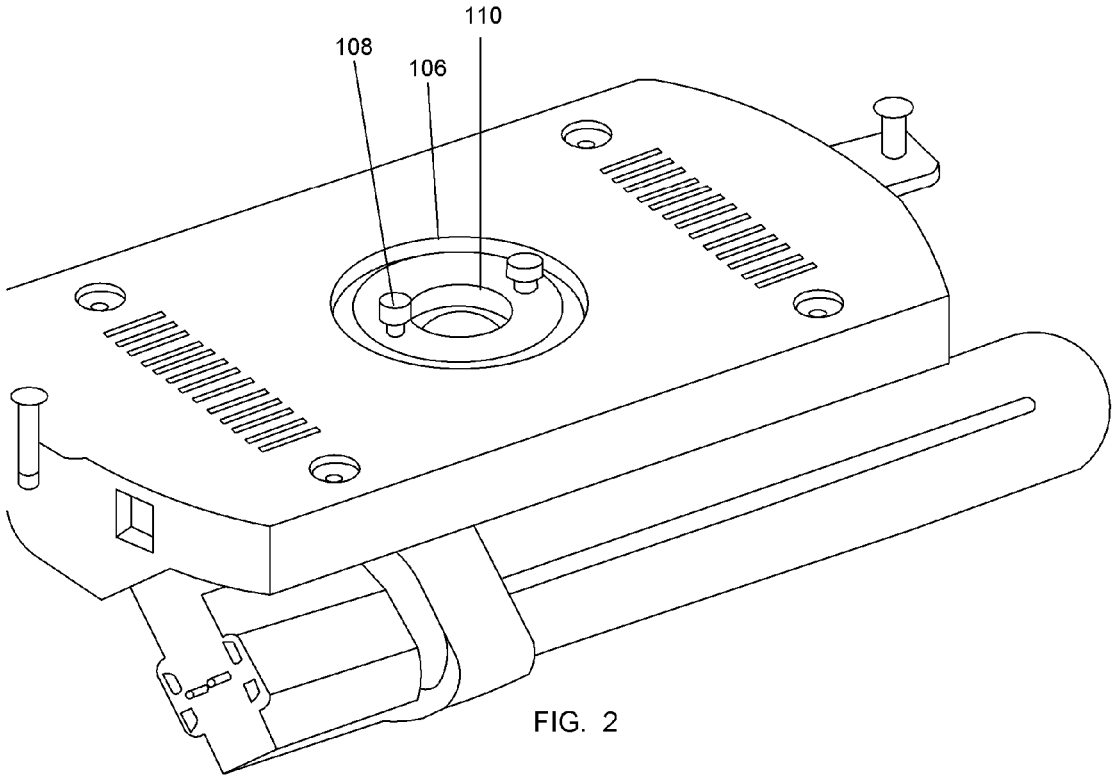
FIG. 2 is a top view illustration of an embodiment of a detachable ballast housing with a GU24 lamp holder mounted thereon.

FIG. 2 is a top view illustration of an embodiment of a detachable ballast housing with a compact fluorescent light mounted thereon.

Figure 3:
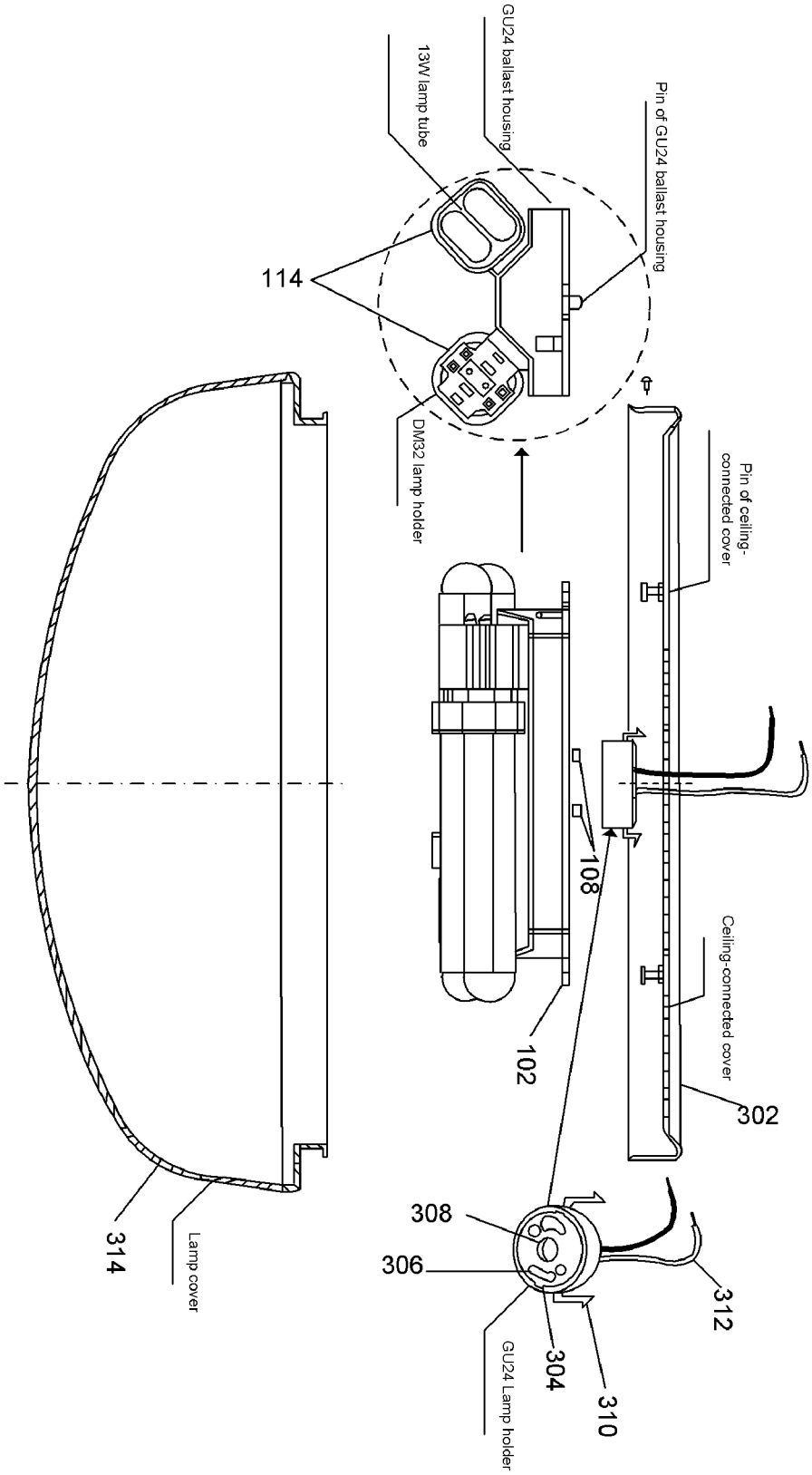
FIG. 3 is an illustration of an embodiment of a detachable ballast housing and lighting fixture.

FIG. 3 is an illustration of an embodiment of a detachable ballast housing and lighting fixture. The lighting fixture 302 includes a mount 304 with wires 312 to interface with the electrical source, typically an A/C power source from a GU24 lamp socket. The mount 304 includes a retaining mechanism 310 to retain the mount 304 and the lighting fixture 302 in a standard A/C lighting electrical wiring box. The GU24 mount socket 304 includes a hole 308, for example of 0.4" outer diameter or smaller, which like the hole 110 in the housing 102, may receive a threaded mounting tube. The mount 304 may include slots 306 to accept the contacts 108 of the ballast housing 102. A light cover 314 may fit over the housing 102 and may mount to the fixture 302.

An expired light bulb may be replaced by removing the cover 314 and disconnecting the bulb from the receptacle 114. An expired ballast may be replaced by removing the cover 314, twisting the ballast housing 102 free of the mount 304, and twisting on a new housing 102. Thus an expired ballast may be replaced without inconvenient and potentially dangerous unwiring of the ballast from the electrical source.

Figure 4:
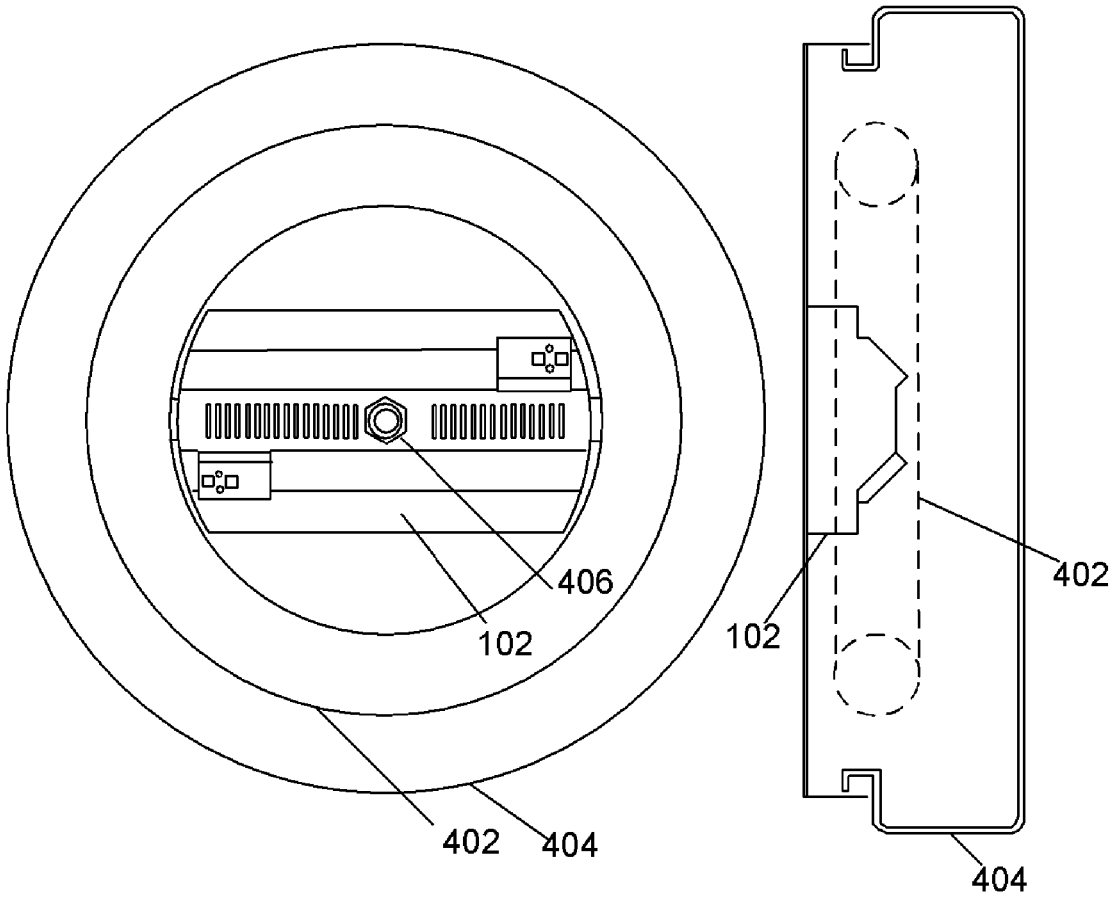
FIG. 4 is an illustration of an embodiment GU24 base of a center hole detachable ballast housing with a "circline" lamp mounted thereon.

FIG. 4 is an illustration of an embodiment of a detachable ballast housing with a "circline" lamp mounted thereon. A circline light 402 attaches to the housing under a fixture 404 via one of the receptacles 114. Note the fitting of the circline light 402 around the curved ends 118 of the housing 102. Note the retaining bolt 406 affixed to a threaded tube that retains the housing 102, mount 304, and fixture 404 to the wall or ceiling (typically to a standard A/C mounting and wiring box recessed into the wall or ceiling).

What is claimed is:

1. A detachable ballast housing for use with fluorescent lights, comprising:

a ballast adapted to mount to a lighting fixture without connecting or disconnecting wires;

a first light bulb connection oriented in a first direction;

a second light bulb connection oriented in a second direction;

the first and second light bulb connections positioned to accept either two linear bulbs or one circline bulb.

2. The ballast housing of claim 1, the first and second bulb connections located to cause linear bulbs to orient alongside a length of the ballast housing.

3. A lighting fixture, comprising:

a base housing a ballast;

the base adapted to rotate around a central hub;

the central hub adapted with electrical contacts for detachably mounting and dismounting to an A/C electrical fixture without connecting or disconnecting power wires;

the base adapted to mount a first linear lighting tube in a first receptacle and a second linear lighting tube in a second receptacle; and the first and second receptacles positioned on the base and adapted to receive electrical contacts of a circline lighting tube.

4. The lighting fixture of claim 3, further comprising:

a hole through the central hub sized to receive a threaded tube for mounting a cover on the fixture.

* * * * *